United States Patent [19]

Pin-Huang

[11] 4,333,259

[45] Jun. 8, 1982

[54] WALL-CLAMBERING TOY SPACE BUG

[75] Inventor: Lin Pin-Huang, Taipei, Taiwan

[73] Assignee: Chen Te-Son, Taipei, Taiwan

[21] Appl. No.: 206,684

[22] Filed: Nov. 13, 1980

[51] Int. Cl.[3] ..... A63H 11/04

[52] U.S. Cl. ..... 46/132; 46/150; 46/266; 180/8 E; 180/901

[58] Field of Search ..... 46/132, 123, 266, 265, 46/264, 248, 149, 150; 180/901, 164, 8 R, 8 C–8 F

[56] References Cited

U.S. PATENT DOCUMENTS

| | | | |
|---|---|---|---|
| 2,779,127 | 1/1957 | Holman | 46/132 X |
| 3,503,152 | 3/1970 | Aoki et al. | 46/132 X |
| 3,612,201 | 10/1971 | Smith | 180/8 E |
| 3,638,354 | 2/1972 | Morrison | 46/132 |
| 4,151,676 | 5/1979 | Clark | 46/149 X |

FOREIGN PATENT DOCUMENTS

| | | | |
|---|---|---|---|
| 162240 | 12/1953 | Australia | 46/132 |
| 374598 | 10/1920 | Fed. Rep. of Germany | 180/8 E |
| 6432 | of 1914 | United Kingdom | 180/8 E |

*Primary Examiner*—Gene Mancene
*Assistant Examiner*—Mickey Yu
*Attorney, Agent, or Firm*—Cushman, Darby & Cushman

[57] ABSTRACT

The present invention relates to a wall clambering toy having both improved layout of its frame and the structure of its sucker, thereby increasing the security of the attachment of the toy to the wall, enhancing the activity, and reducing the power consumption thereof.

7 Claims, 13 Drawing Figures

WALL-CLAMBERING TOY SPACE BUG

BACKGROUND OF INVENTION

This invention relates to a wall-creeping toy.

A conventional wall-clambering toy, like as the toy woodpecker shown in FIG. 1, is provided with a ratchetlike caterpillar wheel provided with a plurality of wheelshoes each of which mounts a sucker disc alternately clinging onto the wall to hang the toy thereto, thus enabling the toy to move along the wall with the rotation of the caterpillar wheel. The layout of such toy however has several defects. First, the force that presses a sucker against the wall so that it may cling onto the wall is considerably weak, thus the suckers cannot always effectively fasten to the wall. Next, the caterpillar wheel is substantially a circle which geometrically allows only one point, i.e., the tangential point, to contact with the tangent line, in other words, only the sucker in its nadir functions to cling to the wall at a time, while the other suckers remain functionless, hence resulting in the poor suction thereof. Third, when a sucker is to leave the wall which it just attaches to, the subsequent sucker has not yet fastened to the wall. At this instance of the transference of clinging suckers, the suction of the precedent sucker weakens. Fourth, since this geometrically circular caterpillar wheel results in the tall posture of the toy, the arm of force between the center of gravity of the toy and the point the toy contacts with the wall is relatively long, thus forming a large torque exerting on the contacting point which is unfavorable to the security of the attachment of the suckers. Consequently, all the aforesaid defects weaken the clambering ability of the toys, and always lead to the failure of a clinging so that a hanging toy may fall off from the wall.

Accordingly, it is the important object of the present invention to provide an improved wall clambering toy to obviate or mitigate the foregoing drawbacks.

According to a feature of this invention, the suckers are mounted on two frame members alternately tramping on the wall. Preferably, the suckers on each frame member are equal both in size and in number so that the suspended suckers on one frame member are subsequently anchored to the wall by an equal force as a result of the counteraction yielded by concurrently pulling the suckers located on the other frame member. Preferably the suckers on one frame member (hereinafter referred to as the longitudinal frame) are lengthwise arranged in alignment with respect to the direction the toy moves, whereas the remaining suckers on the other frame member (hereinafter referred to as transverse frame) are symmetrically and abreast arranged on both sides of the longitudinal frame to ensure the balance of the toy. The longitudinal frame and the transverse frame are mechanically connected with each other in such a manner that they can make relative to-and-fro longitudinal reciprocation accompanied by a periodical change of their height relative to each other, thereby causing the alternate anchoring and detachment of the suckers. When the suckers on the traverse frame anchor to the wall, the suckers on the longitudinal frame remain suspended in the air. Yet when the latter lowers and the former starts to rise, it takes considerable force to pull the anchored sucker off the wall, thus yielding a powerful, corresponding counteraction which presses on the suckers on the longitudinal frame so that they may cling to the wall, and vice versa.

Another feature of this invention lies in that each sucker is provided with a means which can slightly lift up the rim of a sucker to remove the vacuum therein when the sucker is to be pulled off from the wall, thereby facilitating the detachment of the sucker and smoothening the clambering motion.

An embodiment of this invention will be described, by way of example only, with reference to the accompanying drawings, in which:

DETAILED DESCRIPTION OF PREFERRED EMBODIMENT

Figure 1:
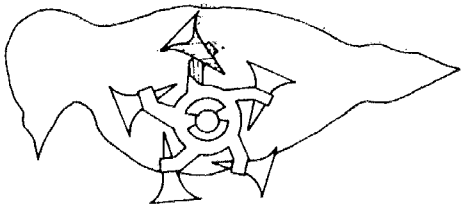
FIG. 1 is a graphical representation of a conventional wall-creeping toy woodpecker.
Figure 3B:
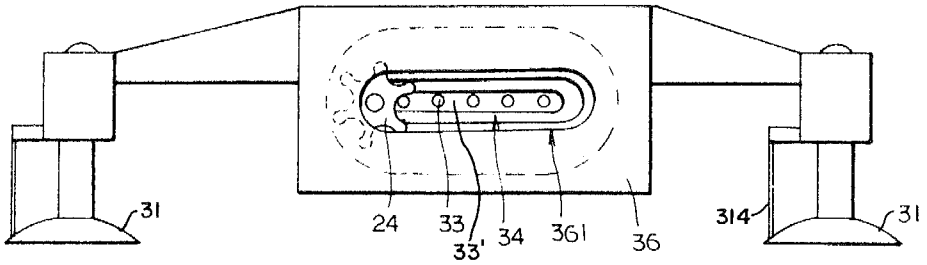
FIG. 3B is a graphical representation showing the mechanical connection between the two frame members.
Figure 2:
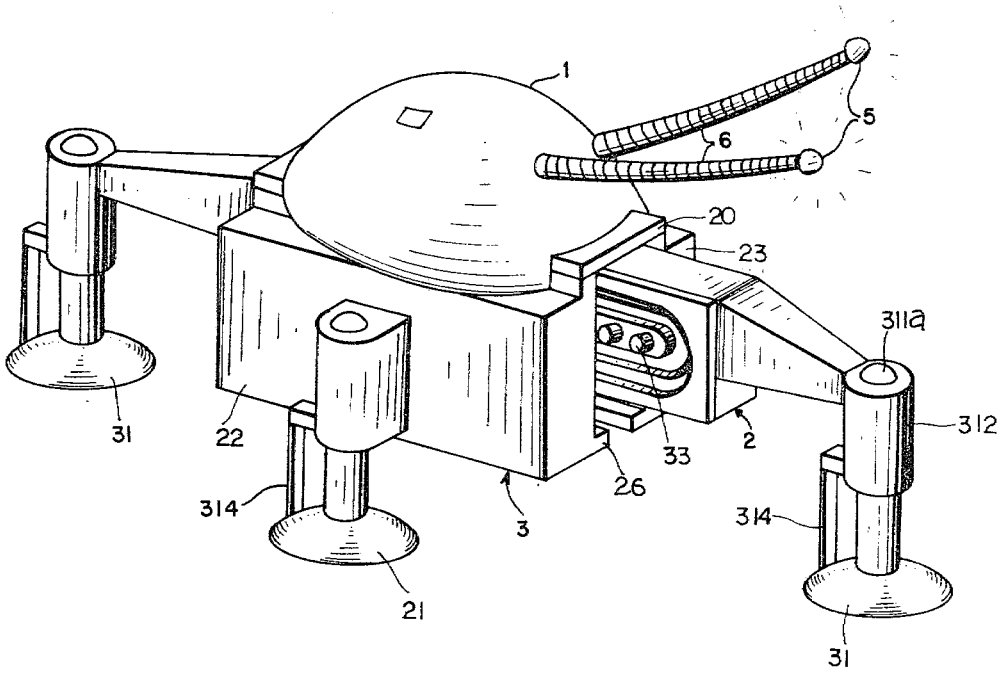
FIG. 2 is a perspective view of a toy space bug embodying this invention.
Figure 3A:
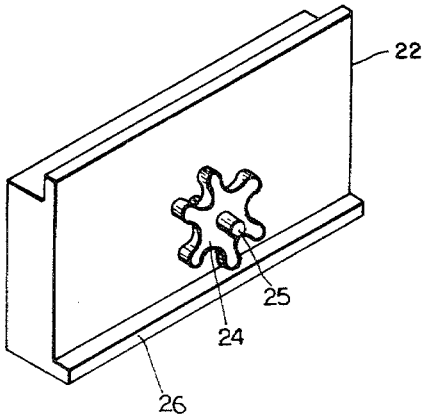
FIG. 3A is a perspective view revealing the concealed side of the right segment of the transverse frame.
Figure 3:
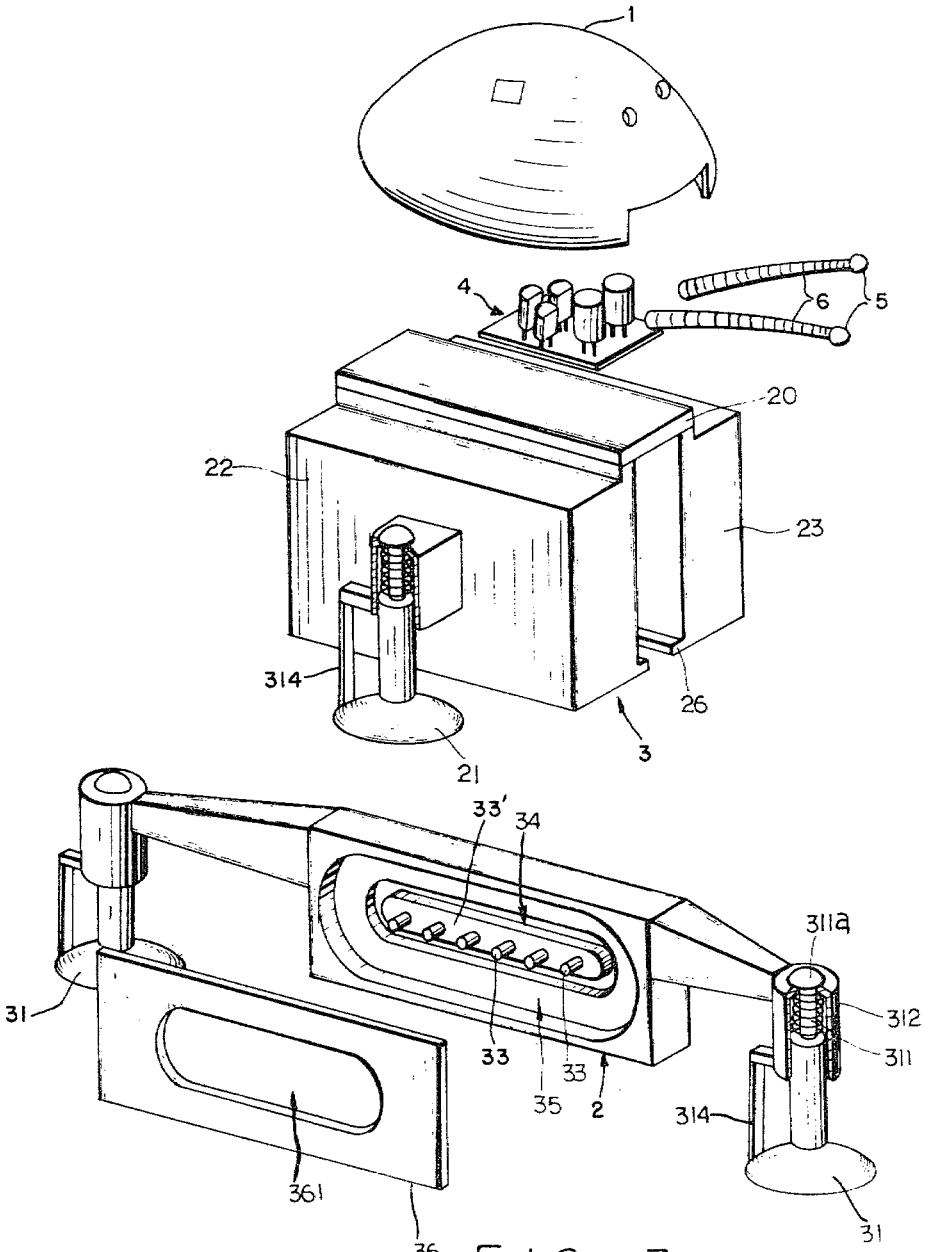
FIG. 3 is an exploded view of the toy shown in FIG. 2.

With reference now to the drawings, and particularly FIG. 2 thereof, this invention comprises three substantial portions: a canopy 1, a longitudinal frame 2, and a transverse frame 3. In FIG. 3 there is shown a simple electronic device 4 to cause a flickering or flashing effect of the LEDs 5 on the tip of the antennae 6 of the top space bug which extend through openings in the canopy 1 to enhance the realism and amusement. These, however, are all well known art: thus a detailed description is unnecessary.

Preferably, both canopy 1, including the accessory electronic elements 4 thereunder, and the driving means (not shown in the drawings) are mounted on transverse frame 3 which is mechanically connected with the longitudinal frame 2 so that they can make back-and-forth reciprocating motion relative to each other accompanied by periodical change of their relative height, thus the suckers 31 attached on the opposite ends of the longitudinal frame 2 (hereinafter referred to as longitudinal suckers) periodically rise to a level above the suckers 21 on transverse frame 3 (hereinafter referred to as transverse suckers) and lower to a level thereunder. When the transverse suckers 21 anchor to a wall, the longitudinal suckers 31 are moving forward until they are depressed and stamped on the wall to take over the anchoring function of the transverse suckers, and vice versa. As a result, when a sucker is elevated to leave the wall and then stamped again onto the wall, its latter position is advanced beyond its former position by a distance depending on the length the sucker moves in the air. In so doing, the toy is allowed to travel on the wall with the aid of its suckers, just like a cripple laming his way on a pair of crutches.

the embodiment hereunder provides an economical yet satisfactory driving mechanism to produce desirable reciprocation of the frame members. However, it must be stated that the embodiment is merely the simplest prototype in terms of its layout, and does not restrict this invention thereto.

Preferably, transverse frame 3 is devised as a bilaterally symmetrical construction comprising two parallel, like segments 22, 23 to receive a driving motor and batteries respectively (not shown in the drawing) to ensure uniform weight distribution; the motor being encased in the right segment 22 and the batteries in the left segment 23. The two segments 22, 23 are joined by a top cross piece 20 with a space therebetween receiving the longitudinal frame 3. On the inner side of right segment 22 there is provided a toothed wheel 24 fixed on a shaft in mechanical connection with the driving system, i.e., the motor (not shown). The shaft protrudes beyond the wheel 24 to form a guide shaft or pin 25 the function of which will later be described. Each of the right segment 22 and left segment 23 is equipped with a sucker 21 on their underside, yet only that of the former appears in FIG. 3, whereas that of the latter is hidden behind the transverse frame 3. Either of the right segment 22 or left segment 23 has an inwardly flanged lower inner edge 26, the function of which will later be described.

On each of the front end and rear end of longitudinal frame 2, there is provided a longitudinal sucker 31, with its bell opening downwardly oriented. On the side of longitudinal frame 2 adjacent to the segment provided with driving means (i.e. right segment 22) there is provided a longitudinal row of equidistant projecting pins 33 (equivalent to an endless rack) rising from a narrow platform 33' surrounded by a sporting-track-like guide groove 34 wherealong the adjacent guide shaft 25 travels when toothed wheel 24 is revolving in meshing engagement with the pins 33. Outside guide groove 34, the longitudinal frame 2 forms a recess 35 providing space for toothed wheel 24 to move therein. The platform 33', guide groove 34, and the recess 35 are so structured that when toothed wheel 24 is revolving around the pins 33 with the guide shaft 25 projecting into guide groove 34, the pins 33 always mesh well with the teeth of toothed wheel 24 without obstructing movement of the latter in the recess 35, (more clearly speaking, the teeth on the wheel must not be so long that the wheel will be jammed between two adjacent pins 33) and there is always a clearance between the teeth of the toothed wheel 24 and the wall of recess 35, so as not to cause wear thereof. In order to retain toothed wheel 24 within the recess 35, there is provided a slotted panel 36 to partially close recess 35 and cage toothed wheel 24 therein. The size of the slot 361 in slotted panel 36 is only slightly larger than the shape described by the outer side of guide groove 34 (see FIG. 3B).

To play with this toy, the two suckers located at the lower level, which can be either longitudinal suckers 31, or transverse suckers 21, depending on the posture of the toy, are pressed against a wall to squeeze out the air to create a vacuum therein in order that the toy may be hung on the wall. Then the power is switched on to actuate the motor, the rotation of which, after reduction and transmission to toothed wheel 24, produces a torque sufficient to pull two suckers away from the surface they attach to, and stamp the other two suckers thereonto. As toothed wheel 24 is turning, one of the frames 2 or 3 is moving forward relative to the other. The details of such motion will be well understood from the sequence of graphical representations in FIG. 4 showing the relative positions of the frames. In describing the toy and its operation, the terms "upward", "downward", "height", etc. are used herein to denote distance and direction relative to a wall or other flat surface (which may have any orientation) to which the toy clings, and not in their usual sense of distance and direction relative to an upwardly facing horizontal surface.

Figure 4A:
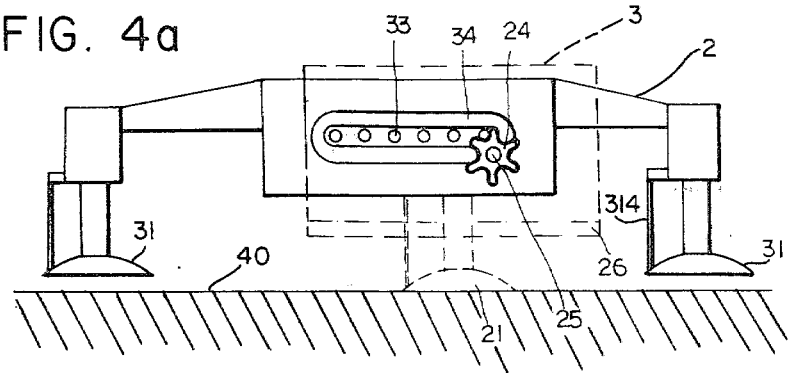
FIG. 4 a-g is a sequence of diagrammatical representations showing the relative positions of the two frame members in a cycle of their periodical motion.
Figure 4B:
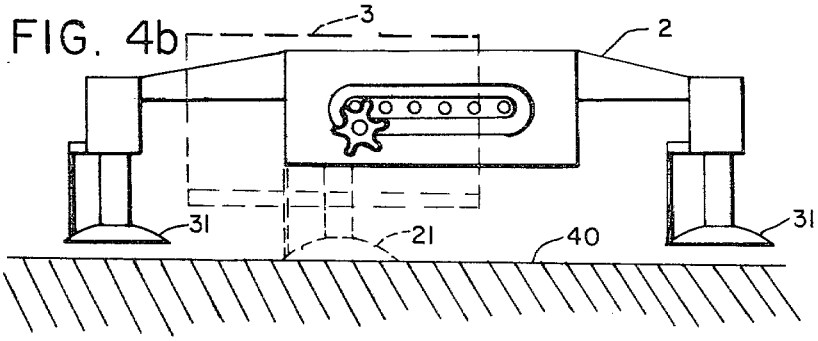
Figure 4C:
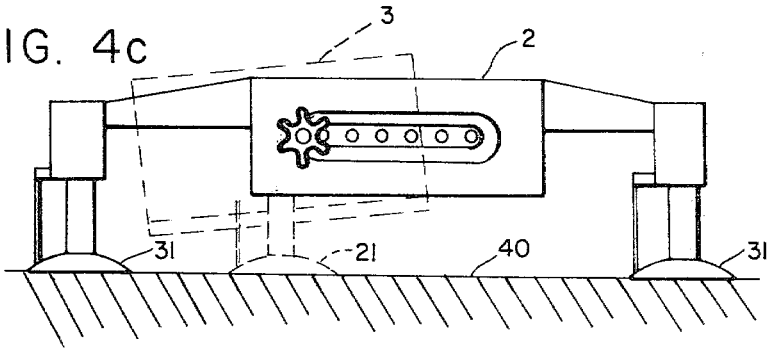
Figure 4D:
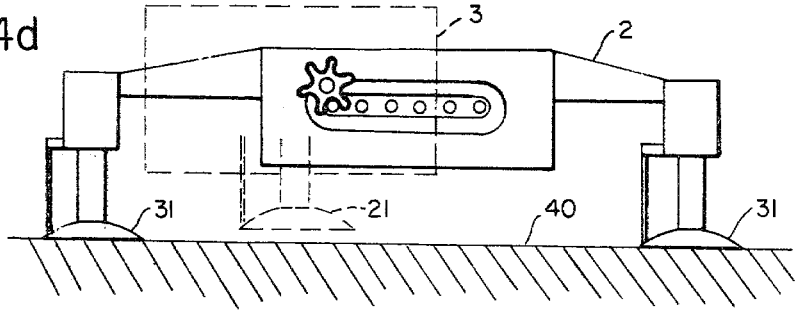
Figure 4E:
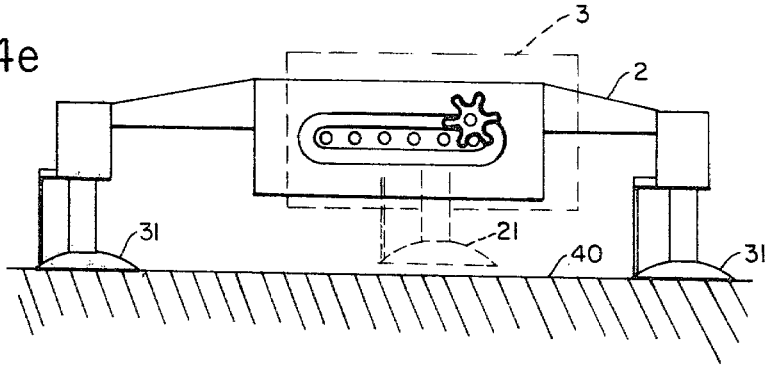
Figure 4F:
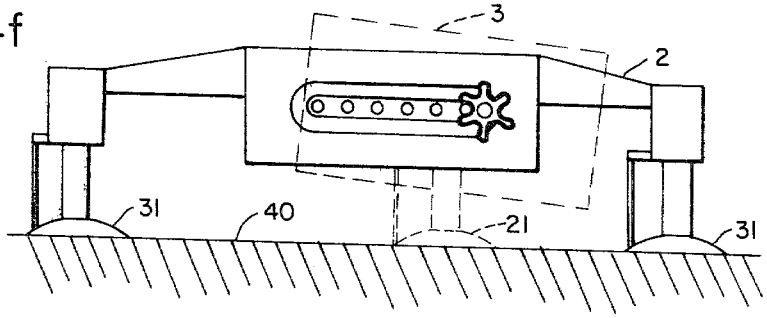
Figure 4G:
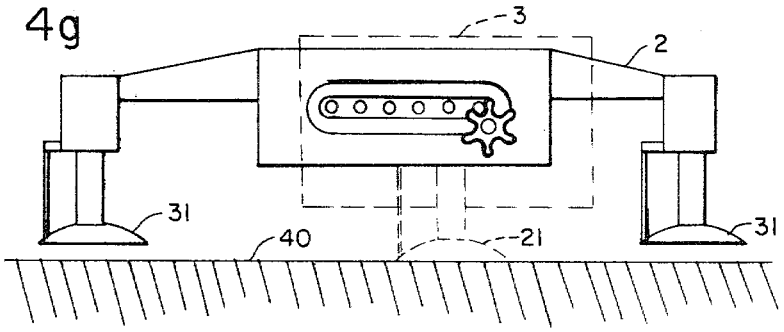

Referring now to FIG. 4*a–g*, the transverse frame 3 is outlined by dashlines, and 40 designates a wall whereon the toy clambers. Each cycle of movement comprises four strokes, namely, upward stroke, forward stroke, downward stroke, and backward stroke, in respect to the position of toothed wheel 24 relative to the pinned platform 33'. The sequence of movement from FIG. 4*a* to FIG. 4*b* comprises the backward stroke; from FIGS. 4*b* to FIG. 4*d* the upward stroke; the forward stroke; and from FIG. 4*e* to FIG. 4*g* the downward stroke. In FIG. 4*a* the transverse suckers 21 cling to the wall 40, while longitudinal suckers 31 are suspended in the air. Inasmuch as during the backward stroke the top of longitudinal frame 2 always contacts with the bridging member 20 interconnecting the right and left segments 22 and 23 of transverse frame 3, the longitudinal frame keeps moving straight forward and parallel to the wall 40. Similarly, during the forward stroke from FIG. 4*d* to 4*e*, while the transverse frame 3 moves forward, the bottom edge of longitudinal frame 2 contacts the flange 26, so the transverse frame 3 is only permitted to move parallel to the wall 40. In FIG. 4*b* the longitudinal frame 2 starts to lower so that the longitudinal suckers 31 may touch the wall 40 and cling onto it to substitute for the transverse suckers 21 which are simultaneously forced to leave the wall with the lifting of transverse frame 3, as shown in FIG. 4*c*. Likewise, when the stage illustrated by FIG. 4*f* is reached, the longitudinal frame 2 begins to rise and pull up its suckers 31, whose task is now undertaken by the transverse suckers 21.

The layout according to this invention has several advantages over the conventional wall creeper toy. Less sucker-disks are required since only one half of them are not clinging to a wall at any time. The lower, prostrate posture of the toy of the present invention not only greatly reduces the moment exerted on the attaching suckers, but also ensures a more successful stamping to anchor a sucker onto a wall. Moreover, the displacement along a wall between two successive "steps" (each stamping of suckers is referred to as one "step" here) is quite long because it is substantially equal to the longitudinal length of the guide groove 34 (i.e., the distance between the front end and the rear end thereof). In contrast, the length of each "step" of the conventional wall creeper toy, which is substantially equal to the distance between two adjacent suckers, is quite short. Since both pulling up and stamping a sucker consume energy, the frequent change of suckers of a conventional toy is undesirable, not to mention that this may greatly encourage the detachment of the toy from the wall.

A tight firm attachment of a sucker, although desired by the present invention in view of increasing its security, will inevitably impede or retard its motion, or even stop it, provided the power produced by the driving system fails to overcome the drag of the sucker. This necessitates greater driving power, which entails more power consumption and a more powerful motor.

Hence, a further feature of the present invention consists in its improved arrangement of suckers, which facilitates the detachment of a sucker when it is desired to pull it up, and prolongs the duration that a sucker fastens to the wall, therefore further enhancing the mechanical efficiency of the machine.

Figure 5:
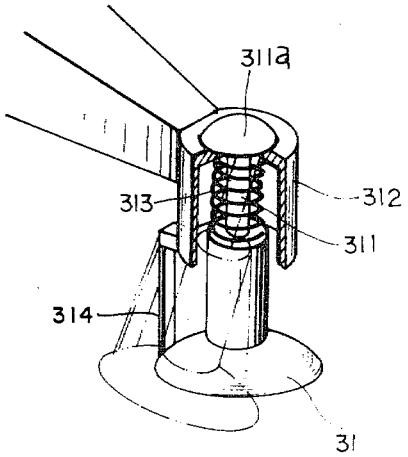
FIG. 5 is a fragmentary perspective view, partly in section, illustrating details of a sucker shown in FIG. 2.

Referring to the mounting of a sucker 31 shown best in FIG. 3 and FIG. 5, the sucker stem 311 is allowed to slide vertically or to rotate and swing within a small angle angularly as illustrated by the dashed lines, within the guide seat 312. Thus when the toothed gear 24 reaches an end bend of guide groove 34, so that either longitudinal frame 2 or transverse frame 3 lowers relative to the wall whereon the toy clambers as illustrated in FIGS. 4*b*, 4*c*, and 4*f*, a sucker stem 311 on a clinging sucker can still keep perpendicular to the wall to avoid the immediate detachment of suckers from the wall due to the change of the distance between guide seat 312 and the wall or the inclination of the sucker stem relative to the seat. A coil compression spring 313 is interposed between the closed end of the seat 312 and a shoulder on the stem 311 to produce a resumptive force which enables a sucker to stand upright immediately when it no longer clings to a surface; for example, assume the state illustrated in solid lines in contrast to that illustrated in dash lines in FIG. 5. Apart from that, the spring 313 also offers a buffering distance, i.e., when the transverse frame 3 (or the longitudinal frame 2) starts rising, their suckers do not follow at once, but remain attached to the wall for a short time. Since pressing the sucker to anchor it to the wall is much easier than pulling it away from the wall while in a clinging state (in other words, the sucker sticks to the wall very quickly when the guide seat lowers so that it contacts the wall initially without considerably compressing the coil spring 313, yet when the guide seat 312 rises, the sucker does not leave the wall until the flanged end 311*a* of sucker stem 311 engages the guide seat 312), when the previously suspended suckers touch the wall and cling thereto, the previously anchored suckers still remain attached to the wall. For this reason, the risk of detachment during the transference of suckers due to the decrease of suction is eliminated.

Inasmuch as the suckers are only pulled up in the stages illustrated in FIGS. 4*c* and 4*f* in which stages the involved frame has the tendency of inclining forwardly or backwardly, the sucker is provided with a flexible yet nonstretchable strip 314, one end of which is attached to the backside of the rim of the sucker, and the other end of which to the guide seat 312. Thus, when a frame inclines forwardly when its suckers are attached to a wall, strip 314 is pulled up to slightly lift up the rim of the corresponding suckers to allow air to enter the cup of each sucker to remove the vacuum therein to facilitate pulling it away from the wall.

The front portion of the toy can be equipped with a touch-triggered electronic means (not shown) which is actuated when the toy approaches the top of a wall and touches the ceiling, to cause counter rotation of the motor in order that the toy may not become stalled, otherwise the player would have trouble reaching it. This, however, is well known art, and there is no need to describe it in detail here.

It is evident that those skilled in this art may now make numerous uses and modifications of and depart from the specific embodiments described herein without departing from the specific inventive concepts. Consequently, the invention is to be construed as embracing each and every novel feature and novel combination of features present in or possessed by the device and techniques herein disclosed and limited solely by the spirit and scope of the appended claims.

What is claimed is:

1. A wall clambering toy comprising:

a longitudinal frame member having wall-attaching sucker means thereon at the opposite ends thereof;

a transverse frame member extending on opposite sides of said longitudinal frame member and having wall-attaching sucker means thereon at the laterally opposite ends thereof;

means mounting said members for reciprocal relative longitudinal movement therebetween accompanied by relative vertical movement therebetween in an opposite direction at each end of said reciprocal longitudinal movement; and power-operated means for effecting movements, whereby the sucker means on one member attach to a wall while the other member advances with its sucker means detached relative to the one member, the other member moves toward and attaches its sucker means to the wall, the one member moves away from and detaches its sucker means from the wall, advances and moves toward and attaches its sucker means to the wall, and the cycle is repeated.

2. The structure defined in claim 1 in which the means for effecting the relative movements comprise:

endless rack means mounted to and extending longitudinally of the longitudinal frame;

driven gear means mounted to the transverse frame for rotation about a transverse axis and meshing with said rack means.

3. The structure defined in claim 2 wherein the rack means includes a row of transverse equispaced pins surrounded by endless guide groove means equidistant from said row, and including a shaft extension on the gear means riding in said groove means.

4. The structure defined in claims 1 or 2 wherein each sucker means includes a stem loosely carried in guide means on the corresponding member for axial and angular movement therein and spring means engaged between said sucker means and its guide means for maintaining said sucker means centered and extended relative to its guide means when not engaged with a wall.

5. The structure defined in claims 1 or 2 wherein the relative movement effecting means causes forward inclination of each frame member as it moves away from a wall and including a flexible non-stretchable strip attached to and between the rear edge of the rim of each sucker means and the corresponding frame member to pull up said rim on said inclination to facilitate detachment of said sucker means from the wall.

6. In a wall clambering toy having at least two frame members, means mounting said members for reciprocal relative longitudinal movement therebetween accompanied by relative vertical movement therebetween in an opposite direction at each end of said reciprocal longitudinal movement, and power-operated means for effecting said movements whereby the sucker means on one member attach to a wall while the other member advances with its sucker means detached relative to the one member, the other member moves toward and attaches its sucker means to the wall, the one member moves away from and detaches its sucker means from the wall, advances and moves toward and attaches the sucker means to the wall, and the cycle is repeated, the improvement wherein each sucker means includes a stem loosely carried in guide means on the corresponding member for axial and angular movement therein and spring means engaged between said sucker means and its guide means for maintaining said sucker means centered and extended relative to its guide means when not engaged with a wall.

7. In a wall clambering toy having at least two frame members, means mounting said members for reciprocal relative longitudinal movement therebetween accompanied by relative vertical movement therebetween in an opposite direction at each end of said reciprocal longitudinal movement, and power-operated means for effecting said movements whereby the sucker means on one member attach to a wall while the other member advances with its sucker means detached relative to the one member, the other member moves toward and attaches its sucker means to the wall, the one member moves away from and detaches its sucker means from the wall, advances and moves toward and attaches the sucker means to the wall, and the cycle is repeated, the improvement wherein the relative movement effecting means causes forward inclination of each frame member as it moves away from a wall and including a flexible non-stretchable strip attached to and between the rear edge of the rim of each sucker means and the corresponding frame member to pull up said rim on said inclination to facilitate detchment of said sucker means from the wall.

* * * * *